US009833672B1

(12) United States Patent
Montejo

(10) Patent No.: US 9,833,672 B1
(45) Date of Patent: Dec. 5, 2017

(54) FOLDABLE GOLF TEE

(71) Applicant: Andres Montejo, San Ysidro, CA (US)

(72) Inventor: Andres Montejo, San Ysidro, CA (US)

( * ) Notice: Subject to any disclaimer, the term of this patent is extended or adjusted under 35 U.S.C. 154(b) by 0 days.

(21) Appl. No.: 15/265,807

(22) Filed: Sep. 14, 2016

(51) Int. Cl.
*A63B 57/00* (2015.01)
*A63B 57/13* (2015.01)

(52) U.S. Cl.
CPC ..... *A63B 57/13* (2015.10)

(58) Field of Classification Search
CPC ..... A63B 57/10–57/19; A63B 57/50
See application file for complete search history.

(56) References Cited

U.S. PATENT DOCUMENTS 1,595,130 A * 8/1926 Wilcox ..... A63B 57/10 473/392
1,717,962 A * 6/1929 Deike ..... A63B 57/16 473/392
1,942,672 A * 1/1934 Thompson ..... A63B 57/10 473/392
2,712,939 A 7/1955 Harp
3,406,978 A * 10/1968 Johnson, Jr. ..... A63B 57/10 473/397
3,966,214 A * 6/1976 Collins ..... A63B 57/10 473/397
4,645,208 A 2/1987 Morabeto
5,755,629 A * 5/1998 Blomgren ..... A63B 57/10 473/397
6,280,350 B1 * 8/2001 Chung ..... A63B 57/10 473/387
6,899,644 B1 5/2005 Song et al.
7,338,394 B2 3/2008 Harris
8,439,771 B1 5/2013 Fleming
8,460,127 B2 6/2013 Kumar
8,936,521 B2 1/2015 Lee
9,216,338 B1 12/2015 Lee et al.
2004/0192474 A1 * 9/2004 Pietsch ..... A63B 57/50 473/387
2005/0064959 A1 * 3/2005 Ortiz ..... G09F 23/00 473/387
2005/0261089 A1 11/2005 Homby
2006/0058120 A1 3/2006 Anton
2006/0105861 A1 5/2006 Yang
2007/0219023 A1 * 9/2007 Stanley ..... A63B 57/207 473/408

(Continued)

*Primary Examiner* — Steven Wong
(74) *Attorney, Agent, or Firm* — Lewis Kohn & Walker LLP; David M. Kohn

(57) ABSTRACT

This invention is a golf tee which folds in three sections articulated to each other. When folded, the tee is compact and its pointed tip is shielded. Compactness is achieved by notching the top of the tee or by offsetting the two articulations with respect to each other. The tee is extensible by a linear ratchet or by a screw, thereby allowing the player to adjust the height. The sections can be assembled at their articulation by a snap-on mechanism. The top section can be made springy by including a coil spring between the articulation and the head of the tee. A snap-lock mechanism allows the tee to remain securely locked in the deployed configuration and in the folded configuration. The folding structure of the tee provides directional information to the player, either pointing backward to indicate the best backswing direction or forward indicating the best follow-through direction.

16 Claims, 13 Drawing Sheets

(56) References Cited

U.S. PATENT DOCUMENTS

| | | | | |
|---|---|---|---|---|
| 2007/0270246 | A1 | 11/2007 | Salmon | |
| 2008/0020868 | A1 | 1/2008 | Palmer | |
| 2008/0146383 | A1* | 6/2008 | Dandelius | A63B 57/10 473/397 |
| 2009/0233727 | A1* | 9/2009 | Tuck | A63B 69/3623 473/257 |
| 2012/0064985 | A1 | 3/2012 | Kumar | |
| 2013/0012332 | A1 | 1/2013 | Leyva | |
| 2013/0331206 | A1 | 12/2013 | Kumar | |
| 2014/0378247 | A1 | 12/2014 | Lee | |

* cited by examiner

FOLDABLE GOLF TEE

FIELD OF THE INVENTION

The present invention relates to the field of golf, more particularly to foldable tees having a compact form factor, and capable of indicating the preferred direction of swing to the player, both for the backswing and follow-through.

BACKGROUND

Each round in the game of golf requires playing a number of holes. A typical round has 9 or 18 holes. The play for each hole begins by putting a ball into play on a tee. The player sinks a tee into the ground and positions the ball on top of the tee. The tee is a small peg with a slightly concave top that supports the ball, and a sharp bottom in the shape of a stake which is pushed down into the ground. Carrying tees in one's pockets is problematic. It is therefore advantageous for the tees to be as compact as possible. In addition tees can make holes in pockets, or injure a player in the event of a fall or collision with an object. It is therefore important for safety reasons and for the sake of wardrobe integrity for the pointed end of the tee to be shielded when the tee is carried by a player.

Another problem encountered by players is the lack of accuracy in their knowledge of the optimum swing direction. Conventional tees do not provide players with any directional information.

The current invention resolves these problems. Further features, aspects, and advantages of the present invention over the prior art will be more fully understood when considered with respect to the following detailed description and claims.

SUMMARY OF THE INVENTION

This invention is a golf tee which folds in three sections articulated to each other. The bottom section has a pointed tip and is articulated to the middle section which is articulated to the top section which holds the head of the tee. In its folded state the tee is compact and its pointed tip is shielded. In addition to being foldable, the tee has several features that improve its functionality.

In its folded state the bottom tip of the tee is shielded by the folding structure.

The bottom section of the tee can be barbed to render the extraction of the tee from the ground more difficult.

The top of the tee can be notched to make room for the pointed tip of the bottom section when the tee is in its folded position.

The top of the tee is extensible. For example it can include a telescoping mechanism that allows the player to adjust the height of the tee. The telescoping mechanism is kept in place by a linear ratchet, or by a screw.

The top section of the tee can be made springy by including a coil spring between the articulation and the ball supporting structure at the top.

The two articulations of the device can be configured with a rotational snap-lock mechanism comprising indentations on one side of the articulation and a bump on the other side. The snap-lock mechanism allows the tee to remain securely locked in the deployed configuration and in the folded configuration.

In addition, the articulations can be assembled for easy manufacturing and storage by a snap-on mechanism.

A compact folded form factor can also be achieved without a notch at the top of the tee by offsetting the articulations on either side of the longitudinal axis going through the middle section.

In its unfolded deployed configuration the tee provides directional information to the player, either pointing backward to indicate the best backswing direction, or pointing forward to indicate the best follow-through direction. The invention also includes a method of swinging a golf club comprising:

a. unfolding the foldable tee;
b. pushing down the pointed end of the tee into the ground with the middle section pointed in a desired direction of a backswing; and
c. performing the backswing in the desired direction.

The invention also includes a method of swinging a golf club comprising:

a. unfolding the foldable tee;
b. pushing down the pointed end of the tee into the ground with the middle section pointed in a desired direction of a follow-through; and
c. performing the follow-through in the desired direction.

BRIEF DESCRIPTION OF THE DRAWINGS

FIG. 12 shows how the middle segment can be used to point in the preferred direction of the follow-through.

DETAILED DESCRIPTION

Figure 1:
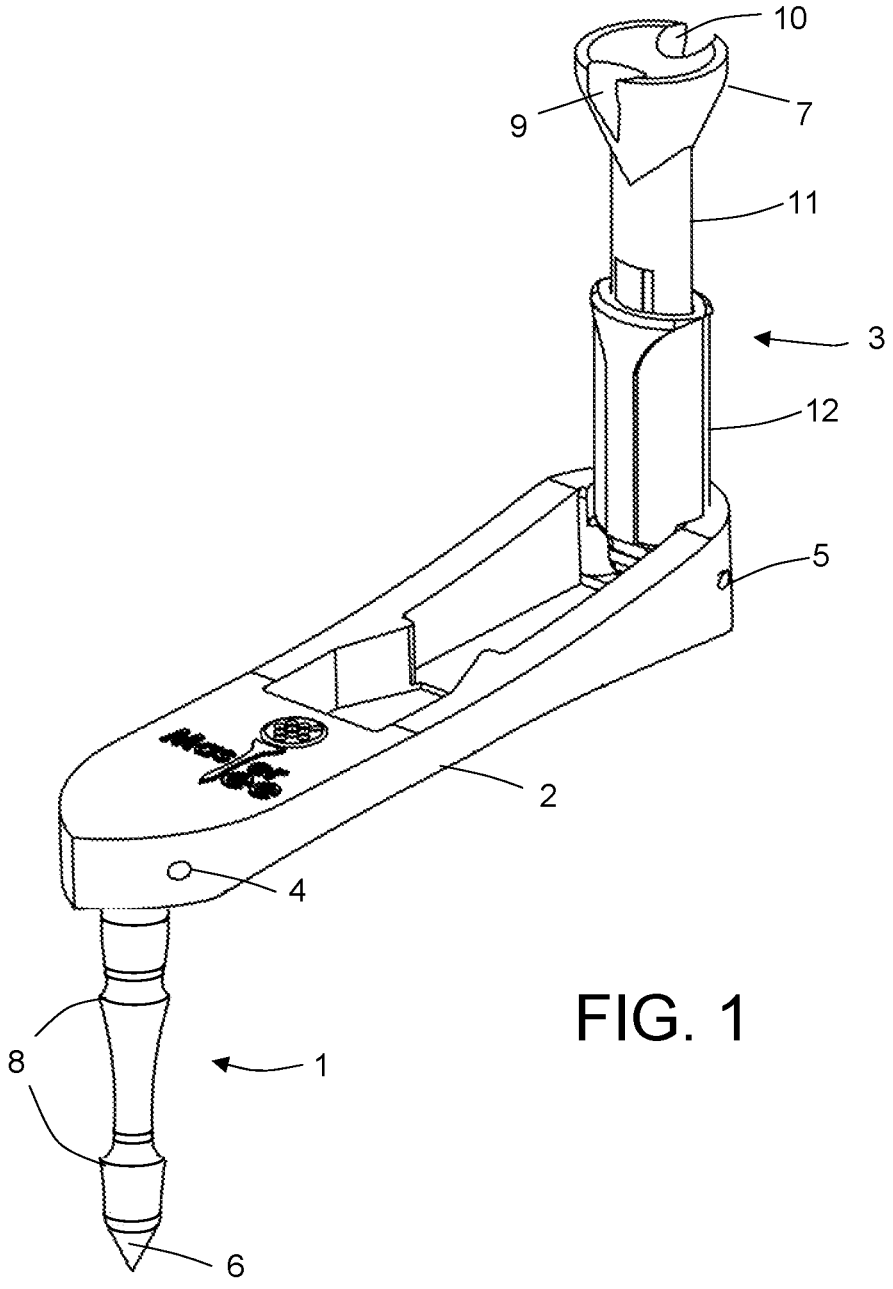
FIG. 1 is a perspective view of the invention in its unfolded configuration.
Figure 2:
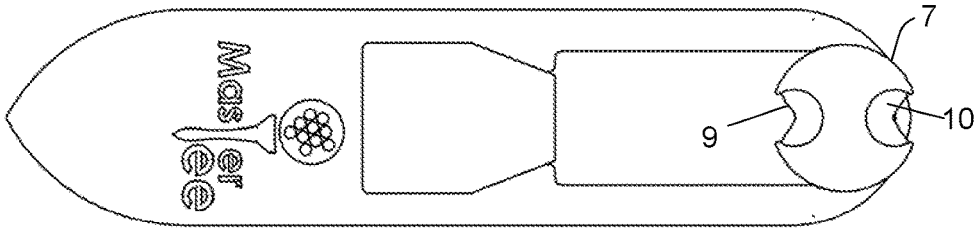
FIG. 2 is a top view of the invention in its unfolded configuration. This view shows the logo used by the invention.

The golf tee invention is described in FIG. 1 in perspective. It comprises a bottom section 1 in the shape of a peg, a middle section 2 and a top section 3 that includes the T head. These three sections are connected by two articulations 4 and 5 allowing the tee to be folded for storage or deployed for use. The invention is shown in its open deployed state in FIG. 1. A top view of the deployed configuration is also provided in FIG. 2. The invention is shown in its folded configuration in FIG. 3.

The bottom section 1 is in the shape of a peg, pointed at the bottom 6, and suitable to be driven into the ground. This section is also articulated 4 at its upper end with the middle section 2. The section can be jagged or shaped with barbs 8 (as in an arrow or fishhook) as shown in the figure, to make extraction from the ground difficult.

The middle section 2 is articulated at one end 4 with the bottom section 1 and articulated at the other end 5 with the top section 3. The middle section 2 is hollow and shaped to shield the pointed end 6 of the bottom section 1 and the top section 3 when the tee is its folded configuration shown in FIG. 3.

Figure 3:
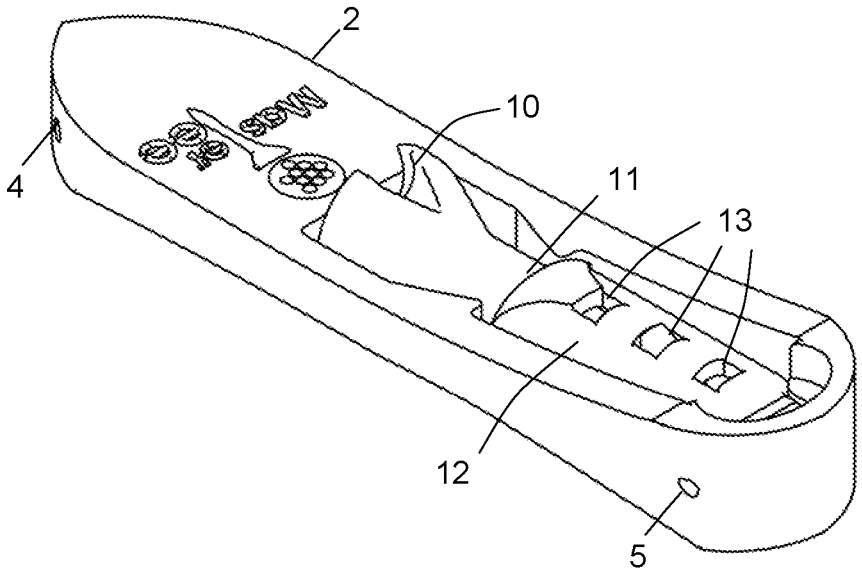
FIG. 3 is a perspective view of the invention in its folded configuration.

The top section 3 includes the head of the tee, widened and with a slightly concave surface 7 at the top, designed to hold the ball. In addition, a notch 9 is configured at the top of the tee, to make room for the bottom of the peg 1 when the device is in a folded configuration as shown in FIG. 3. A second notch 10 may be configured in the head of the tee on the other side of the first notch 9 for symmetry purposes. The top section 3 is articulated at its lower end 5 with the middle section 2.

The top section 3 can be made extensible in a number of ways. For example, it can be configured as a telescope with an inner cylindrical rod 11 sliding in or out of an outer sleeve 12.

Figure 4:
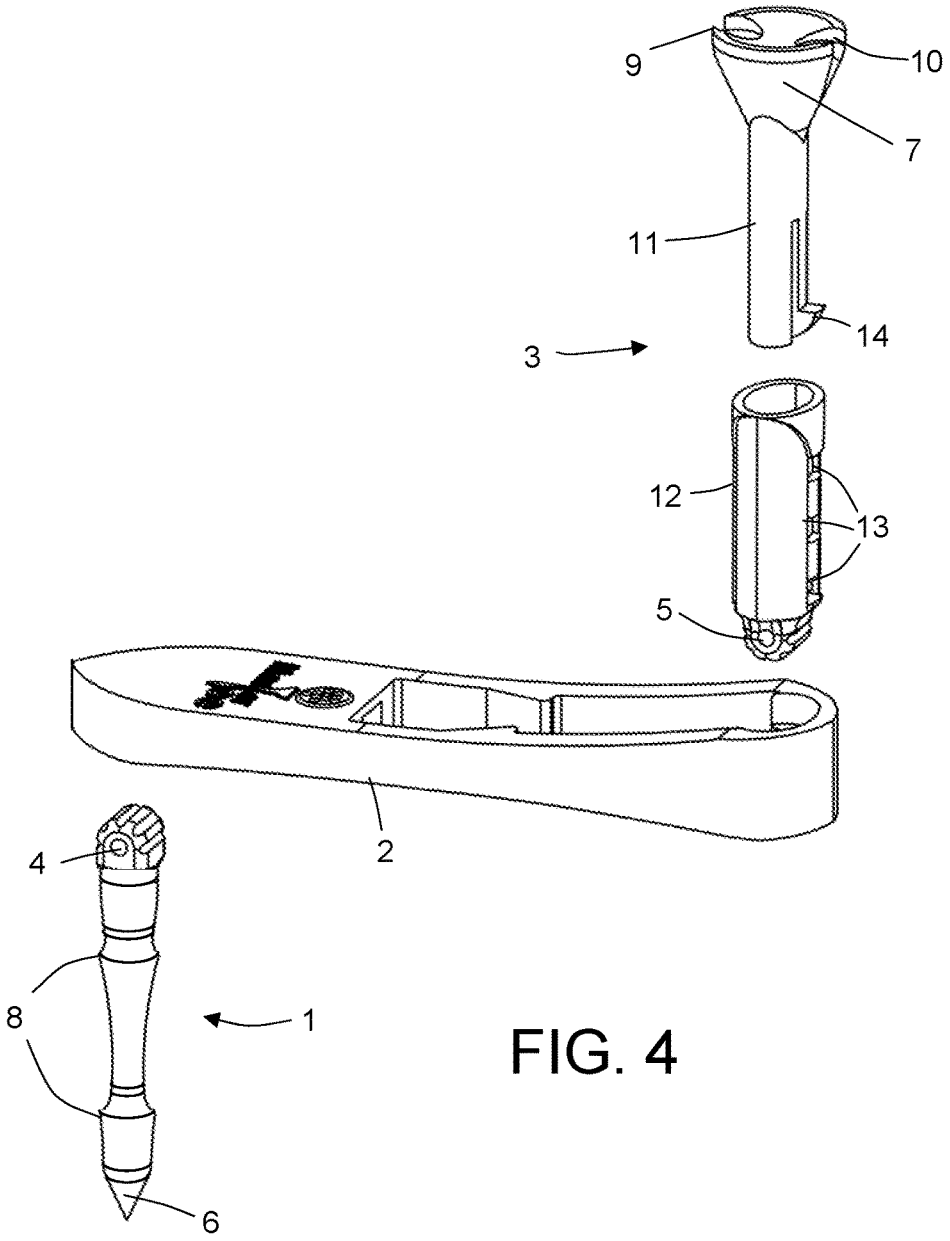
FIG. 4 provides an exploded view of the invention showing the telescoping mechanism that allows the extension of the tee, and also partially showing the rotational snap mechanism built in the articulations.

FIG. 4 provides an exploded view of the device showing the telescopic arrangement of the top section 3. Discrete locked extension states can be implemented by means of a linear ratchet including a series of holes 13 in the outer sleeve 12 and a spring loaded hook 14 in the inner rod 11, the hook 14 shaped to be inserted into the holes 13. Extending the telescope is simple: if the hook 14 is arrow-shaped (or right-angled triangular shaped) as shown in the figure, the user must push the hook 14 out of its hole and pull; if the hook 14 is a simple round bump (not shown in the figure), the user can strongly pull on the tee thereby forcing the bump out of its hole. Compressing the tee down to its compact form is simple: the user pushes down on the top of the tee.

Figure 5A:
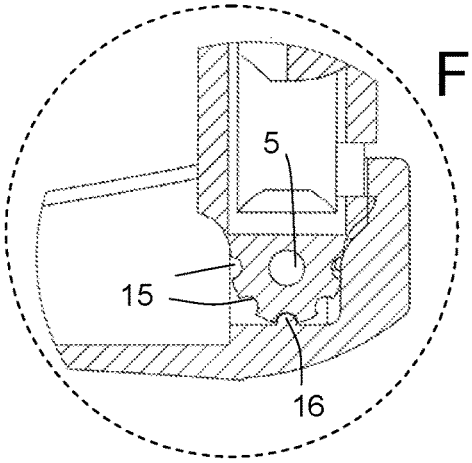
FIG. 5A is a close up view of the upper articulation between the middle section and the top section, showing the upper snap-lock mechanism.
Figure 5:
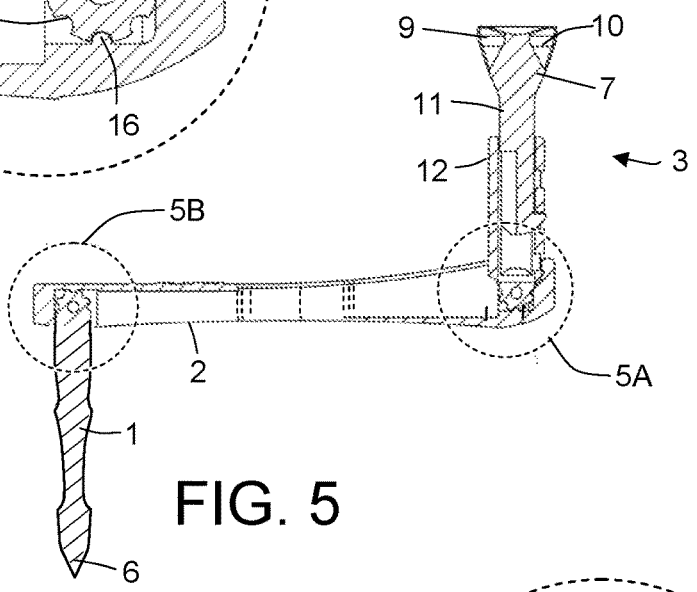
FIG. 5 is a cross sectional view of the invention in its unfolded state, showing the rotational snap mechanism of the articulations.

The deployed and folded configurations can remain stable by means of a rotational snap mechanism configured into the articulations 4 and 5 as illustrated in FIGS. 4 and 5, 5A and 5B. As shown in FIG. 5A the articulation 5 in the top section 3 includes a series of indentations 15 on its side of the articulation 5. The middle section 2 includes a round bump or boss 16 on its side of the articulation 5, which fits into the indentations 15. The combination of indentations 15 and bump 16 allows the top section 3 to rotationally snap into place in either the deployed or the folded configuration.

Figure 5B:
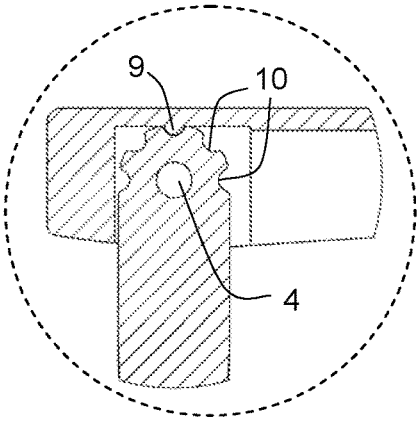
FIG. 5B is a close up view of the lower articulation between the middle section and the bottom peg showing the lower snap-lock mechanism.

As illustrated in FIG. 5B the bottom section 1 is similarly articulated 4 with the middle section 2. Indentations 17 in the middle section 2 matching a bump or boss 18 in the lower section 1 allows the bottom section 1 to rotationally snap into place, either in the deployed or in the folded configuration.

Figure 6:
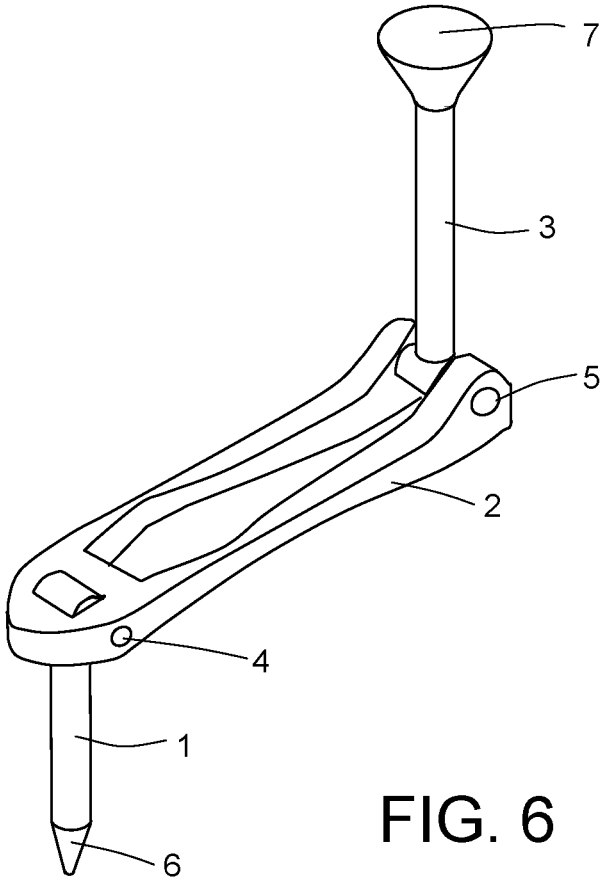
FIG. 6 illustrates a number of variations, including no-notch in the tee head, a non-extensible tee, and a non-barbed bottom peg.

FIG. 6 illustrates a variation on the basic design in which the top section 3 is not extensible. The figure also shows a variation in which the bottom peg 1 does not have any barb but is a simple cylinder pointed at the lower end 6. The figure also shows that the central section can be completely open allowing 360 degree rotation of articulation 5. The figure also shows that the head 7 of the tee does not have a notch.

Figure 7:
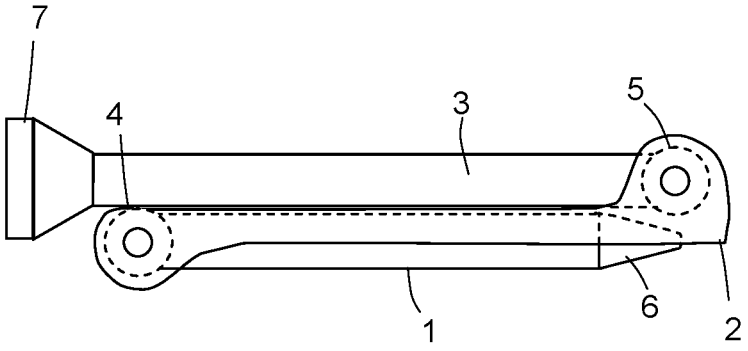
FIG. 7 shows that a compact folded configuration can be achieved without any notch in the top of the tee by offsetting the articulations' axes with respect the middle section.

FIG. 7 shows a configuration in which the articulations 4 and 5 are offset on either side of the middle section 2, thereby allowing the device to be folded without the need to notch the head of the tee.

Figure 8:
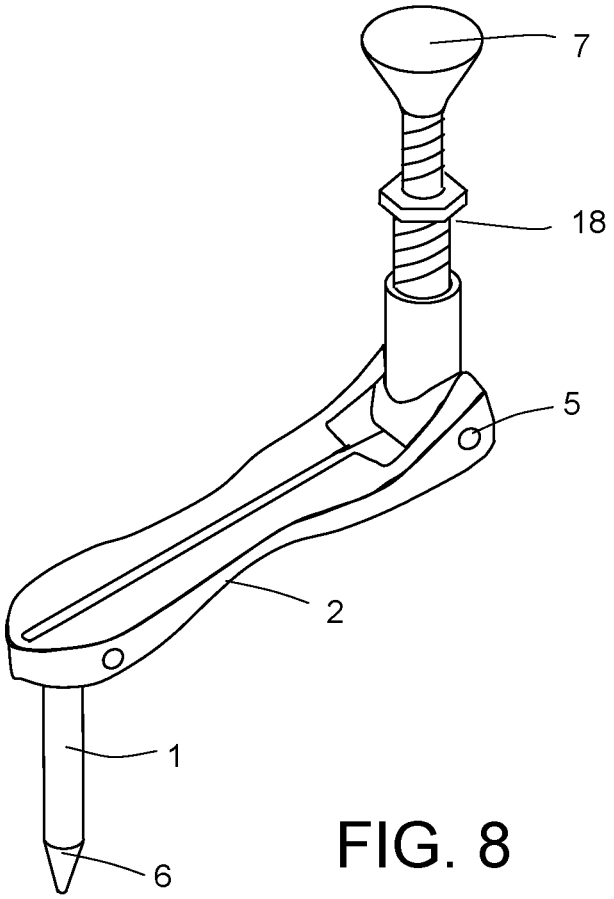
FIG. 8 shows the top segment of the invention as a telescoping screw that allows the height of the tee to be adjusted by the player.

FIG. 8 illustrates a variation in which the extension mechanism for the top section 3 is implemented by a single or a multiple-telescoping screw 18, thereby allowing the top section 3 to be extended according to the preference of the player.

Figure 9:
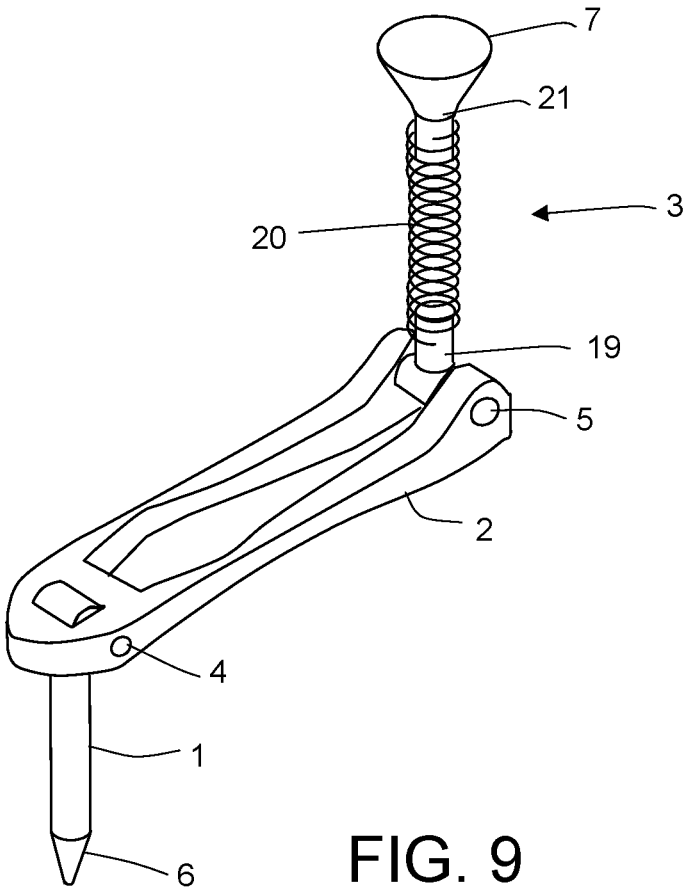
FIG. 9 shows how the top segment can incorporate a coil spring.

FIG. 9 illustrates yet another variation in which the top section 3 is springy. The illustrated embodiment includes a swiveling base 19 pivotally articulated with the middle section 2. A coil spring 20 is supported at its lower end by the swiveling base 19. At its top end, the coil spring 20 supports the ball support structure 21 with a slightly concave top surface. Yet another variation is to incorporate in the top section 3 a blade spring instead of a coiled spring between the articulation 5 and the head 7.

Figure 10:
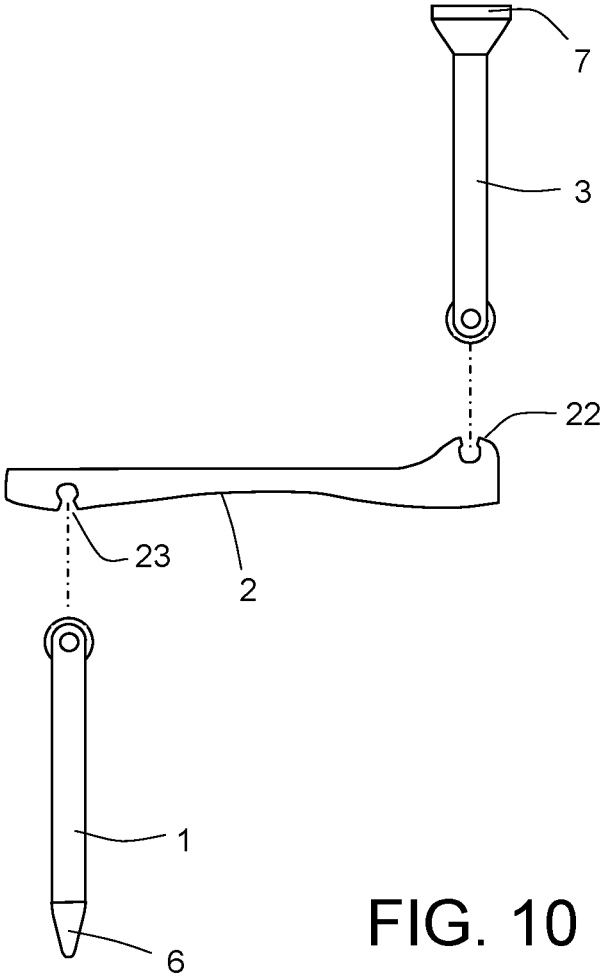
FIG. 10 provides a side view showing the articulations with snap-on mechanisms that allows the invention to be quickly assembled or disassembled.

FIG. 10 shows another possible variation on the basic design, in which at least one of the top and bottom sections is assembled with the middle section by means of snap-on mechanisms 22 and 23.

Figure 11:
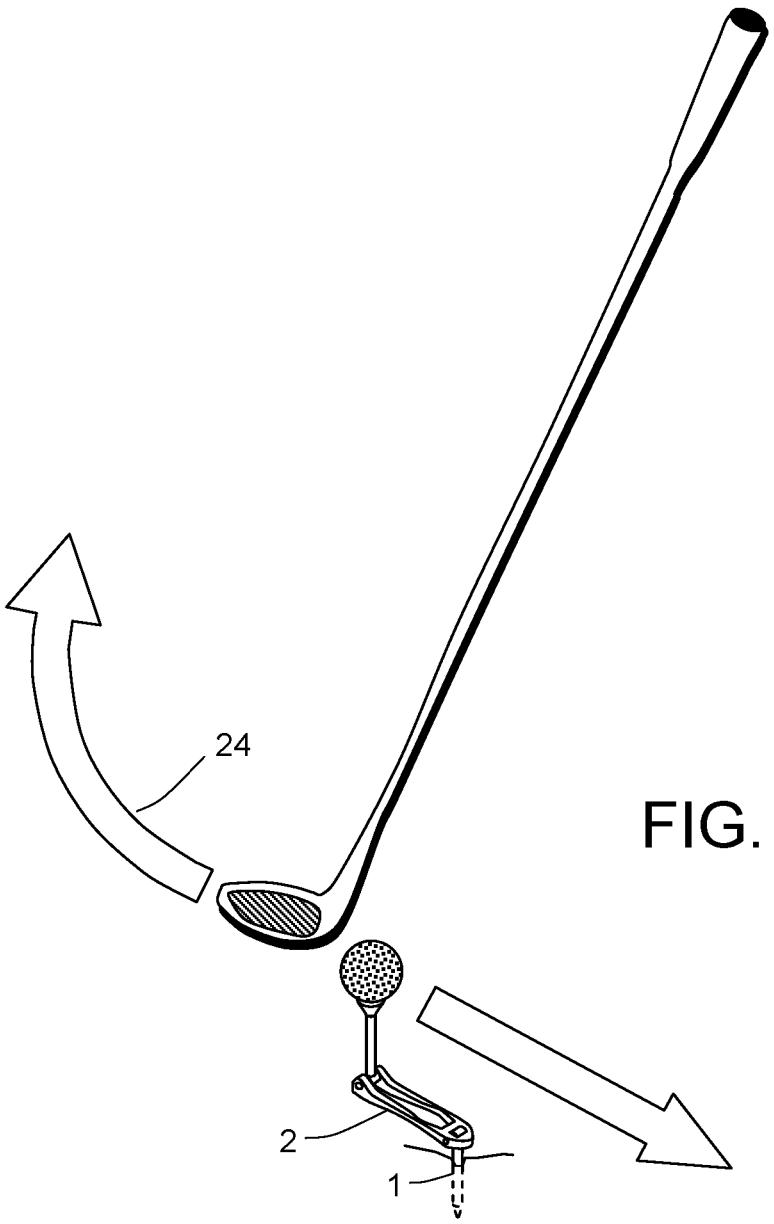
FIG. 11 shows how the middle segment can be used to point in the preferred direction of the backswing.

Foldability makes this invention more compact than conventional tees. The invention is also safer because the pointed tip of the tee is shielded. Another advantage of the invention is that it provides the player with directional information. As shown in FIG. 11, the middle section 2 can be pointed backward thereby indicating the optimum back-swing 24 direction.

Figure 12:
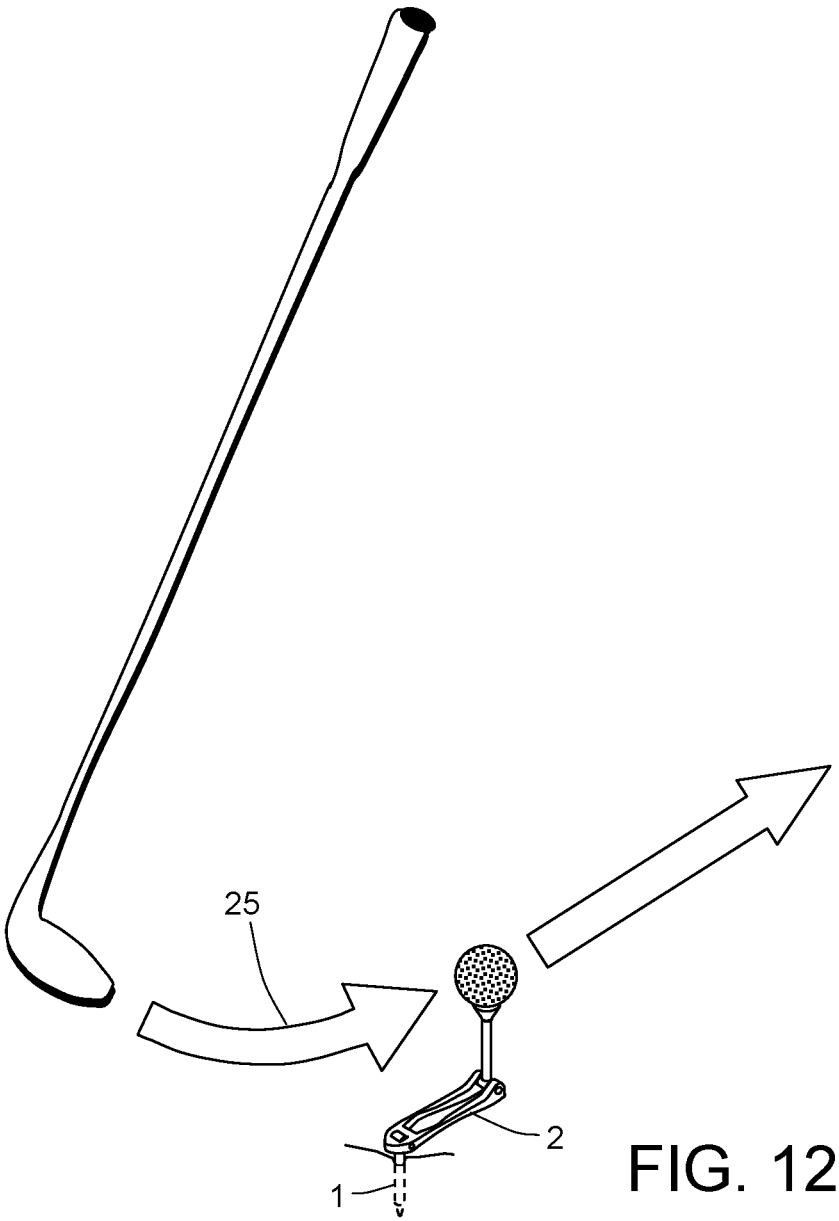

The middle section can also be pointing forward as shown in FIG. 12, thereby indicating the best follow-through 25 direction.

Figure 13:
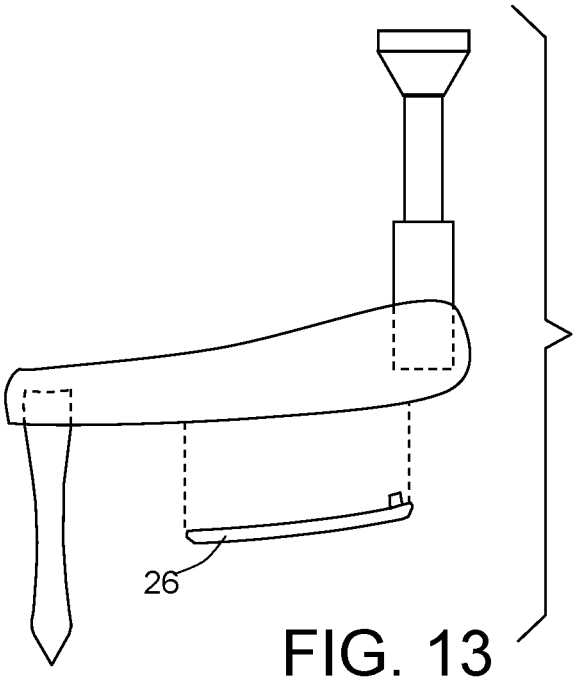
FIG. 13 is an exploded view showing a belt clip added to the foldable tee.
Figure 13A:
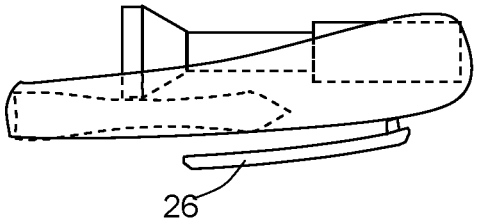
FIG. 13A shows the belt clip attached to the foldable tee.
Figure 13B:
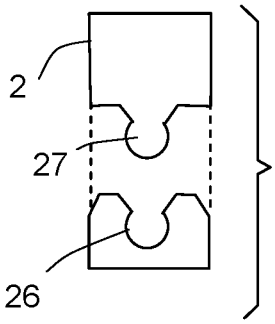
FIG. 13B illustrates a snap on mode of attachment of the belt clip to the foldable tee.

The foldable tee can also include a belt clip as shown in an exploded view in FIG. 13 and in assembled and folded view in FIG. 13A. A clip on mode of attachment of the belt clip is shown in FIG. 13B. The clip-on method of attachment requires a concavity 26 on the belt clip and a convexity 27 on the foldable tee (or vice versa).

While the above description contains many specificities, the reader should not construe these as limitations on the scope of the invention, but merely as exemplifications of preferred embodiments thereof. Those skilled in the art will envision many other possible variations within its scope. Accordingly, the reader is requested to determine the scope of the invention by the appended claims and their legal equivalents, and not by the examples which have been given.

I claim:

1. A foldable tee for supporting a golf ball, comprised of:

a. a bottom section having a pointed end;

b. a middle section articulated to said bottom section by a bottom articulation; and c. a top section articulated to said middle section by a top articulation, said top section having a top surface, said top surface shaped for stably supporting said golf ball; said bottom articulation and said top articulation allowing said foldable tee to be in a folded state or in an unfolded deployed state, further wherein the top section is configured as a telescopically extensible mechanism, further comprising a linear ratchet and a screw.

2. The foldable tee of claim 1 wherein said pointed end of said bottom section is shielded when said tee is in a folded state.

3. The foldable tee of claim 1 wherein said top section is extensible.

4. The foldable tee of claim 1 wherein said bottom section and said middle section are assembled by a snap-on mechanism.

5. The foldable tee of claim 1 wherein said middle section and said top section are assembled by a snap-on mechanism.

6. The foldable tee of claim 1 wherein said bottom section and said middle section are joined to each other by means of a snap-lock articulation.

7. The foldable tee of claim 6 wherein said snap-lock articulation has two sides, a first said side configured with at least one indentation, and a second said side configured with at least one bump fitting in said at least one indentation.

8. The foldable tee of claim 1 wherein said middle section and said top section are joined to each other by means of a snap-lock articulation.

9. The foldable tee of claim 8 wherein said snap-lock articulation has two sides, a first said side configured with at least one indentation, and a second said side configured with at least one bump fitting in said at least one indentation.

10. The foldable tee of claim 1 wherein said bottom section is barbed.

11. The foldable tee of claim 1 wherein said middle section has a longitudinal axis and said bottom articulation and said top articulation are offset on opposite sides of said longitudinal axis.

12. The foldable tee of claim 1 carrying a logo.

13. The foldable tee of claim 1 also comprising a belt clip.

14. A method of swinging a golf club using said foldable tee of claim 1 comprising:

a. unfolding said foldable tee;

b. pushing down said pointed end of said foldable tee in the ground with said middle section pointed in a desired direction of a backswing; and c. performing said backswing in said desired direction.

15. A method of swinging a golf club using said foldable tee of claim 1 comprising:

a. unfolding said foldable tee;

b. pushing down said pointed end of said foldable tee in the ground with said middle section pointed in a desired direction of a follow-through; and c. performing said follow-through in said desired direction.

16. A foldable tee for supporting a golf ball, comprised of:

a. a bottom section having a pointed end;

b. a middle section articulated to said bottom section by a bottom articulation; and c. a top section articulated to said middle section by a top articulation, said top section having a top surface, said top surface shaped for stably supporting said golf ball;

said bottom articulation and said top articulation allowing said foldable tee to be in a folded state or in an unfolded deployed state, wherein said top surface is shaped with a notch being configured to make room for said pointed end of said bottom section when said foldable tee is in a folded configuration, further wherein said pointed end of said bottom section is shielded by said notch when said tee is in a folded state.

* * * * *